US011571892B2

(12) United States Patent
Nishimura et al.

(10) Patent No.: US 11,571,892 B2
(45) Date of Patent: Feb. 7, 2023

(54) MANIFOLD LENGTH IN A PRINTHEAD

(71) Applicants: Hiroshi Nishimura, West Hills, CA (US); Giang Vo, Simi Valley, CA (US); Cesar Hurtado, Simi Valley, CA (US)

(72) Inventors: Hiroshi Nishimura, West Hills, CA (US); Giang Vo, Simi Valley, CA (US); Cesar Hurtado, Simi Valley, CA (US)

(73) Assignee: Ricoh Company, Ltd., Tokyo (JP)

( * ) Notice: Subject to any disclaimer, the term of this patent is extended or adjusted under 35 U.S.C. 154(b) by 102 days.

(21) Appl. No.: 17/194,869

(22) Filed: Mar. 8, 2021

(65) Prior Publication Data

US 2022/0281222 A1 Sep. 8, 2022

(51) Int. Cl.
*B41J 2/14* (2006.01)

(52) U.S. Cl.
CPC .. *B41J 2/14201* (2013.01); *B41J 2002/14419* (2013.01); *B41J 2202/11* (2013.01)

(58) Field of Classification Search
CPC ..... B41J 2/14201; B41J 2002/14419; B41J 2202/11
See application file for complete search history.

(56) References Cited

U.S. PATENT DOCUMENTS

| | | | |
|---|---|---|---|
| 5,455,615 | A | 10/1995 | Burr et al. |
| 5,907,338 | A | 5/1999 | Burr et al. |
| 6,003,971 | A | 12/1999 | Hanks et al. |
| 6,402,282 | B1 | 6/2002 | Webb |
| 8,382,256 | B2 | 2/2013 | Suzuki |
| 9,487,001 | B2 | 11/2016 | Nishi et al. |
| 2006/0007272 | A1 | 1/2006 | Ogata et al. |
| 2007/0120904 | A1 | 5/2007 | Sekiguchi |
| 2008/0129771 | A1 | 6/2008 | Kim |

FOREIGN PATENT DOCUMENTS

| | | | |
|---|---|---|---|
| EP | 0721840 | B1 | 4/2001 |
| JP | 2005246663 | A | 9/2005 |
| JP | 2009056786 | B | 12/2011 |

OTHER PUBLICATIONS

IP.com search (Year: 2022).*
International Search Report and Written Opinion, Application PCT/JP2022/007570; dated Jun. 9, 2022.
Sharon S. Berger et al; Ink Manifold Design of Phase Change Piezoelectric Ink Jets; Recent progress in Ink Jet Technologies II, 1999.

* cited by examiner

*Primary Examiner* — Lisa Solomon
(74) *Attorney, Agent, or Firm* — Duft & Bornsen, PC

(57) ABSTRACT

Printheads and manifolds within printheads. In one embodiment, a method comprises determining a resonant frequency of jetting channels for a printhead, and selecting a target length for a manifold fluidly coupled to the jetting channels such that resonant frequencies of the manifold differ from the resonant frequency of the jetting channels by a threshold amount.

20 Claims, 9 Drawing Sheets

MANIFOLD LENGTH IN A PRINTHEAD

TECHNICAL FIELD

The following disclosure relates to the field of image formation, and in particular, to printheads and the design of printheads.

BACKGROUND

Image formation is a procedure whereby a digital image is recreated by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and a diaphragm that vibrates in response to an actuator, such as a piezoelectric actuator. A printhead also includes a driver circuit that controls when each individual jetting channel fires based on image or print data. To jet from a jetting channel, the driver circuit provides a jetting pulse to the actuator, which causes the actuator to deform a wall of the pressure chamber (i.e., the diaphragm). The deformation of the pressure chamber creates pressure waves within the pressure chamber that eject a droplet of print fluid (e.g., ink) out of the nozzle.

Multiple jetting channels within a printhead are fluidly coupled to a common fluid path that conveys the print fluid, which is referred to as a manifold. One problem encountered within printheads is that pressure waves may escape from the jetting channels, and propagate along the manifold. The pressure waves in the manifold can affect jetting in individual jetting channels, which can result in jetting instability.

SUMMARY

Embodiments described herein provide for printheads and the design of printheads having a manifold of a target length. If a manifold in a printhead vibrates at the same frequency as the jetting channels in the printhead, the manifold vibration can act to excite the pressure waves in the manifold that escape from the jetting channels. This can unfortunately create a variation in jetting performance from channel-to-channel. Thus, the length of a manifold in a printhead is selected so that its resonant frequencies are different than the resonant frequency of the jetting channels. One technical benefit of selecting the length of a manifold in this manner is that manifold vibration will not excite pressure waves escaping from the jetting channels and propagating in the manifold, and will improve jetting consistency and performance.

One embodiment comprises a method that includes determining a resonant frequency of jetting channels for a printhead, and selecting a target length for a manifold fluidly coupled to the jetting channels such that resonant frequencies of the manifold differ from the resonant frequency of the jetting channels by a threshold amount.

Another embodiment comprises a design tool for a printhead. The design tool comprises at least one processor and memory that causes the design tool to determine a resonant frequency of jetting channels for the printhead, and to select a target length for a manifold fluidly coupled to the jetting channels such that resonant frequencies of the manifold differ from the resonant frequency of the jetting channels by a threshold amount.

Another embodiment comprises a printhead comprising a plurality of jetting channels, and a manifold fluidly coupled to the jetting channels. A length of the manifold is selected to produce resonant frequencies that differ from a resonant frequency of the jetting channels by a threshold amount.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
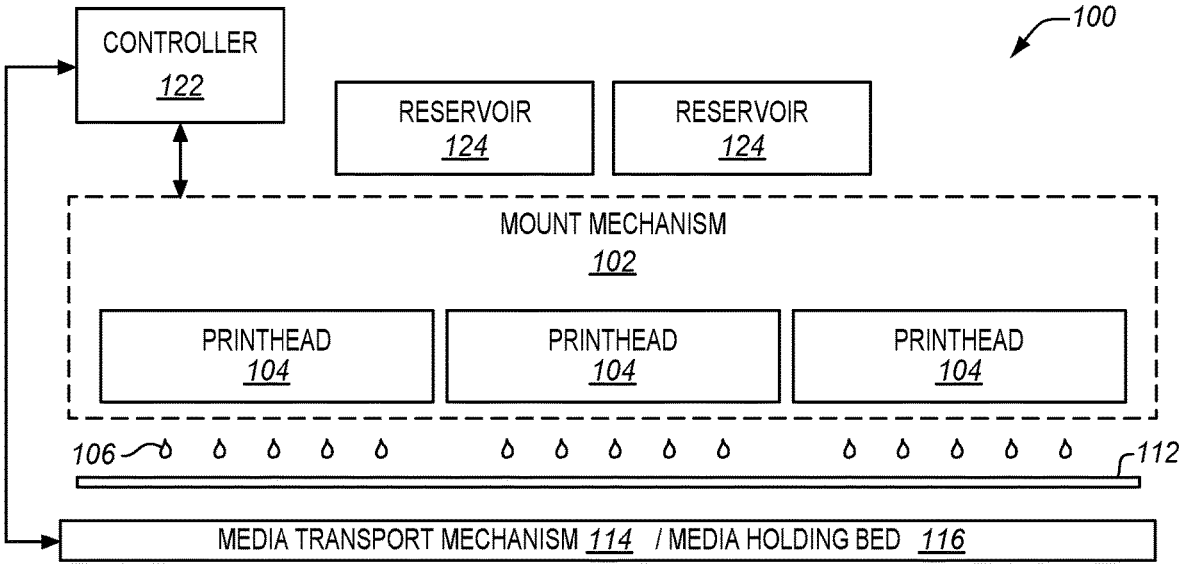
FIG. 1 is a schematic diagram of a jetting apparatus in an illustrative embodiment.

FIG. 1 is a schematic diagram of a jetting apparatus 100 in an illustrative embodiment. A jetting apparatus 100 is a device or system that uses one or more printheads to eject a print fluid or marking material onto a medium. One example of jetting apparatus 100 is an inkjet printer (e.g., a cut-sheet or continuous-feed printer) that performs single-pass printing. Other examples of jetting apparatus 100 include a scan pass inkjet printer (e.g., a wide format printer), a multifunction printer, a desktop printer, an industrial printer, a 3D printer, etc. Generally, jetting apparatus 100 includes a mount mechanism 102 that supports one or more printheads 104 in relation to a medium 112. Mount mechanism 102 may be fixed within jetting apparatus 100 for single-pass printing. Alternatively, mount mechanism 102 may be disposed on a carriage assembly that reciprocates back and forth along a scan line or sub-scan direction for multi-pass printing. Printheads 104 are a device, apparatus, or component configured to eject droplets 106 of a print fluid, such as ink (e.g., water, solvent, oil, or UV-curable), through a plurality of nozzles (not visible in FIG. 1). The droplets 106 ejected from the nozzles of printheads 104 are directed toward medium 112. Medium 112 comprises any type of material upon which ink or another marking material is applied by a printhead, such as paper, plastic, card stock, transparent sheets, a substrate for 3D printing, cloth, etc. Typically, nozzles of printheads 104 are arranged in one or more rows so that ejection of a print fluid from the nozzles causes formation of characters, symbols, images, layers of an object, etc., on medium 112 as printhead 104 and/or medium 112 are moved relative to one another. Jetting apparatus 100 may include a media transport mechanism 114 or a media holding bed 116. Media transport mechanism 114 is configured to move medium 112 relative to printheads 104. Media holding bed 116 is configured to support medium 112 in a stationary position while the printheads 104 move in relation to medium 112.

Jetting apparatus 100 also includes a jetting apparatus controller 122 that controls the overall operation of jetting apparatus 100. Jetting apparatus controller 122 may connect to a data source to receive print data, image data, or the like, and control each printhead 104 to discharge the print fluid on medium 112. Jetting apparatus 100 also includes one or more reservoirs 124 for a print fluid. Although not shown in FIG. 1, reservoirs 124 are fluidly coupled to printheads 104, such as with hoses or the like.

Figure 2:
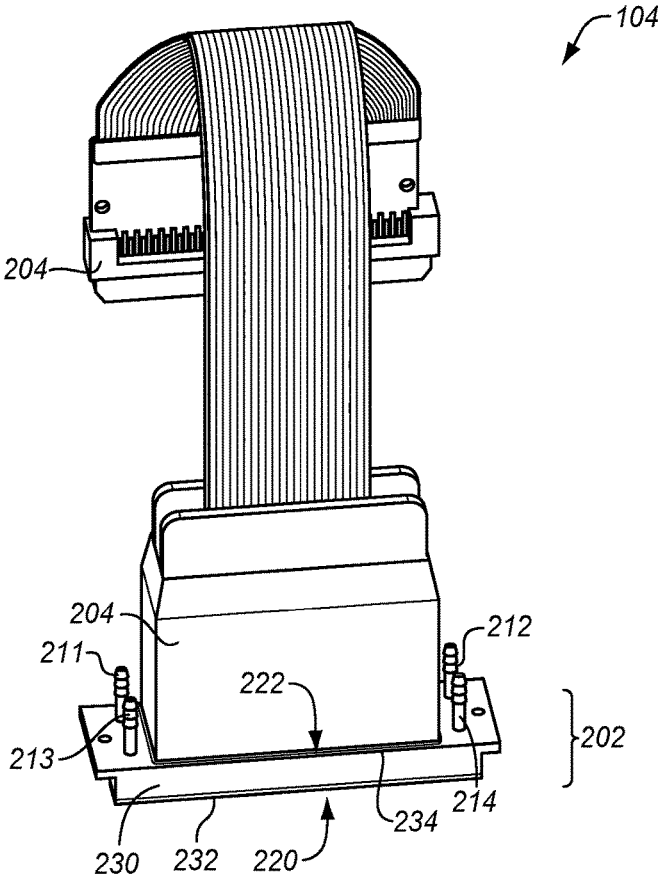
FIG. 2 is a perspective view of a printhead in an illustrative embodiment.

FIG. 2 is a perspective view of a printhead 104 in an illustrative embodiment. In this embodiment, printhead 104 includes a head member 202 and electronics 204. Head member 202 is an elongated component that forms the jetting channels of printhead 104. A typical jetting channel includes a nozzle, a pressure chamber, and a diaphragm that is driven by an actuator, such as a piezoelectric actuator. Electronics 204 control how the nozzles of printhead 104 jet droplets in response to data signals and control signals. Although not visible in FIG. 2, electronics 204 may include one or more driver circuits configured to drive actuators (e.g., piezoelectric actuators) that contact the diaphragms of the jetting channels. Electronics 204 connect to a controller (e.g., jetting apparatus controller 122) to receive the data signals and control signals. The controller is configured to provide the data signals and control signals to printhead 104 to control jetting of the individual jetting channels, to control the temperature of printhead 104, etc.

The bottom surface of head member 202 in FIG. 2 includes the nozzles of the jetting channels, and represents the discharge surface 220 of printhead 104. The top surface of head member 202 in FIG. 2 (referred to as I/O surface 222) represents the Input/Output (I/O) portion for receiving one or more print fluids into printhead 104, and/or conveying print fluids (e.g., fluids that are not jetted) out of printhead 104. I/O surface 222 includes a plurality of I/O ports 211-214. An I/O port 211-214 may comprise an inlet I/O port, which is an opening in head member 202 that acts as an entry point for a print fluid. An I/O port 211-214 may comprise an outlet I/O port, which is an opening in head member 202 that acts as an exit point for a print fluid. I/O ports 211-214 may include a hose coupling, hose barb, etc., for coupling with a hose of a reservoir, a cartridge, or the like. The number of I/O ports 211-214 is provided as an example, as printhead 104 may include other numbers of I/O ports.

Head member 202 includes a housing 230 and a plate stack 232. Housing 230 is a rigid member made from stainless steel or another type of material. Housing 230 includes an access hole 234 that provides a passageway for electronics 204 to pass through housing 230 so that actuators may interface with (i.e., come into contact with) diaphragms of the jetting channels. Plate stack 232 attaches to an interface surface (not visible) of housing 230. Plate stack 232 (also referred to as a laminate plate stack) is a series of plates that are fixed or bonded to one another to form a laminated stack. Plate stack 232 may include the following plates: one or more nozzle plates, one or more chamber plates, one or more restrictor plates, and a diaphragm plate. A nozzle plate includes a plurality of nozzles that are arranged in one or more rows (e.g., two rows, four rows, etc.). A chamber plate includes a plurality of openings that form the pressure chambers of the jetting channels. A restrictor plate includes a plurality of restrictors that fluidly connect the pressure chambers of the jetting channels with a manifold. A diaphragm plate is a sheet of a semi-flexible material that vibrates in response to actuation by an actuator (e.g., piezoelectric actuator).

The embodiment in FIG. 2 illustrates one particular configuration of a printhead 104, and it is understood that other printhead configurations are considered herein that have a plurality of jetting channels.

Figure 3:
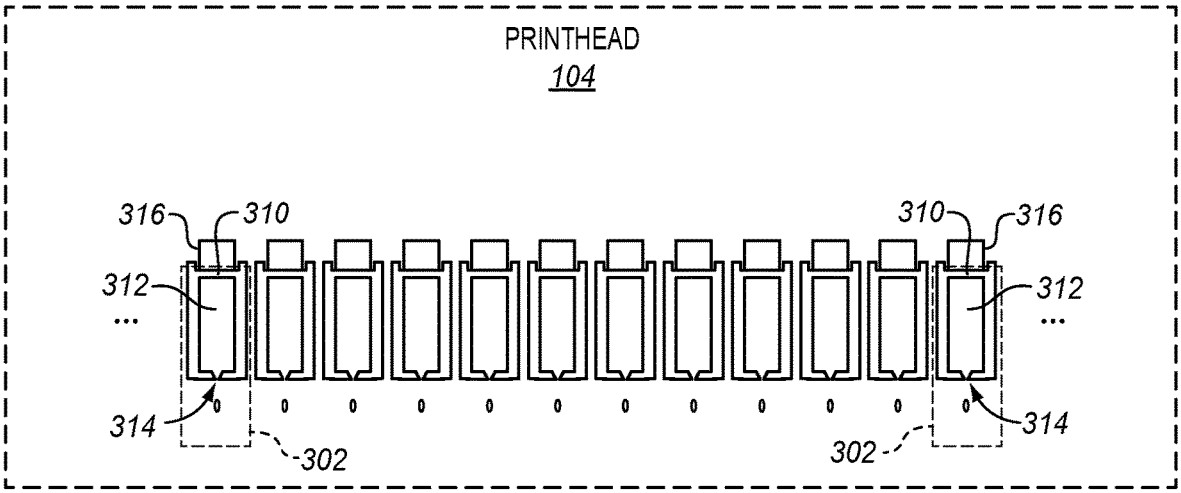
FIG. 3 is a schematic diagram of jetting channels within a printhead in an illustrative embodiment.

FIG. 3 is a schematic diagram of jetting channels 302 within a printhead 104 in an illustrative embodiment. This diagram represents a view along a length of printhead 104. A jetting channel 302 is a structural element within printhead 104 that jets or ejects a print fluid. Each jetting channel 302 includes a diaphragm 310, a pressure chamber 312, and a nozzle 314. An actuator 316 contacts diaphragm 310 to control jetting from a jetting channel 302. Jetting channels 302 may be formed in one or more rows along a length of printhead 104, and each jetting channel 302 may have a similar configuration as shown in FIG. 3.

Figure 4:
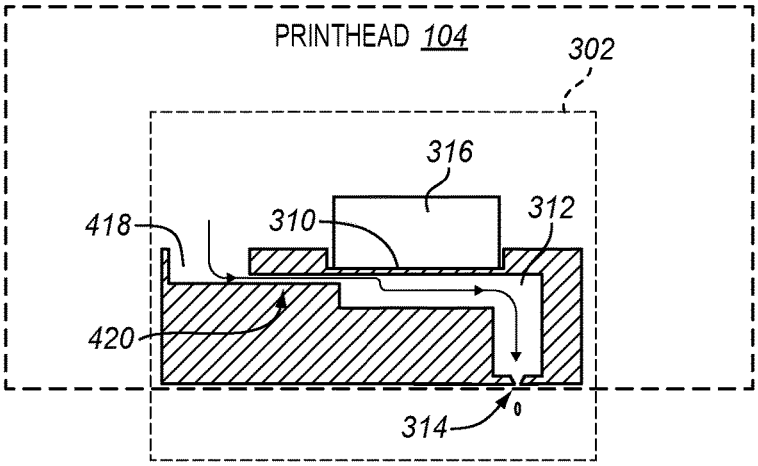
FIG. 4 is another schematic diagram of a jetting channel within a printhead in an illustrative embodiment.

FIG. 4 is another schematic diagram of a jetting channel 302 within a printhead 104 in an illustrative embodiment. The view in FIG. 4 is of a cross-section of a jetting channel 302 across a width of a portion of printhead 104. Pressure chamber 312 is fluidly coupled to a manifold 418 through a restrictor 420. Restrictor 420 controls the flow of the print fluid from manifold 418 to pressure chamber 312. One wall of pressure chamber 312 is formed with diaphragm 310 that physically interfaces with actuator 316. Diaphragm 310 may comprise a sheet of semi-flexible material that vibrates in response to actuation by actuator 316. The print fluid flows through pressure chamber 312 and out of nozzle 314 in the form of a droplet in response to actuation by actuator 316. Actuator 316 is configured to receive a jetting pulse, and to actuate or "fire" in response to the jetting pulse. Firing of actuator 316 in jetting channel 302 creates pressure waves in pressure chamber 312 that cause jetting of a droplet from nozzle 314.

A jetting channel 302 as shown in FIGS. 3-4 is an example to illustrate a basic structure of a jetting channel, such as the diaphragm, pressure chamber, and nozzle. Other types of jetting channels are also considered herein. For example, some jetting channels may have a pressure chamber having a different shape than is illustrated in FIGS. 3-4. Also, the position of a manifold 418, a restrictor 420, a diaphragm 310, etc., may differ in other embodiments.

Figure 5:
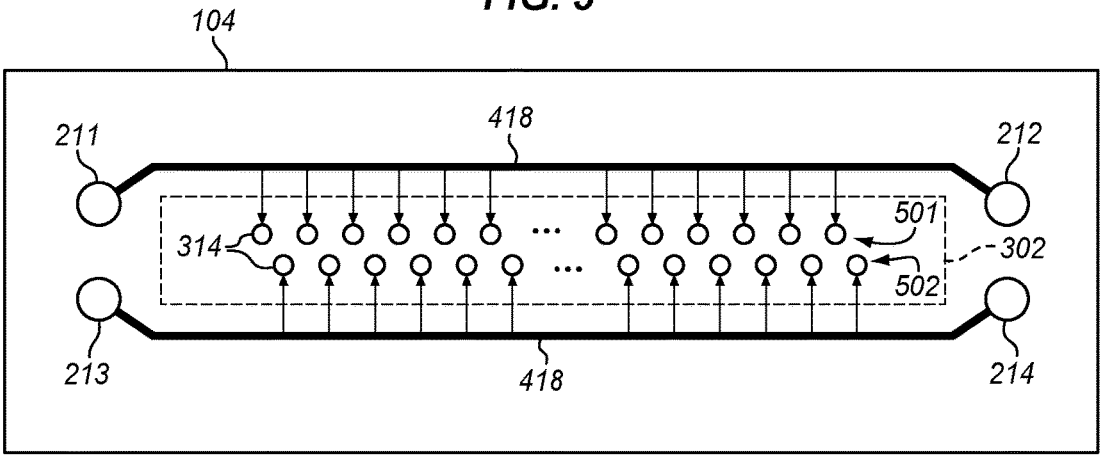
FIG. 5 is a schematic diagram of a printhead in an illustrative embodiment.

FIG. 5 is a schematic diagram of a printhead 104 in an illustrative embodiment. The jetting channels 302 of printhead 104 are schematically illustrated in FIG. 5 as nozzles 314 in two nozzle rows 501-502. Although the nozzles 314 are shown as staggered in FIG. 5, the nozzles 314 in the nozzle rows 501-502 may be aligned in other embodiments. Printhead 104 (i.e., head member 202) includes a plurality of manifolds 418. A manifold 418 is a common fluid path in a printhead 104 for a plurality of jetting channels 302. A manifold 418 that conveys a print fluid to a plurality of jetting channels 302 may also be referred to as a "supply" manifold. One of the manifolds 418 comprises a fluid path between I/O ports 211-212 that is fluidly coupled to the jetting channels 302 in nozzle row 501. Thus, a print fluid supplied at I/O port 211 and/or I/O port 212 is conveyed through manifold 418 to the jetting channels 302 in nozzle row 501. Another one of the manifolds 418 comprises a fluid path between I/O ports 213-214 that is fluidly coupled to the jetting channels 302 in nozzle row 502. Thus, a print fluid supplied at I/O port 213 and/or I/O port 214 is conveyed through manifold 418 to jetting channels 302 in nozzle row 502. Although two manifold 418 are illustrated in FIG. 5, a printhead 104 may include more or less manifolds as desired.

Figure 6:
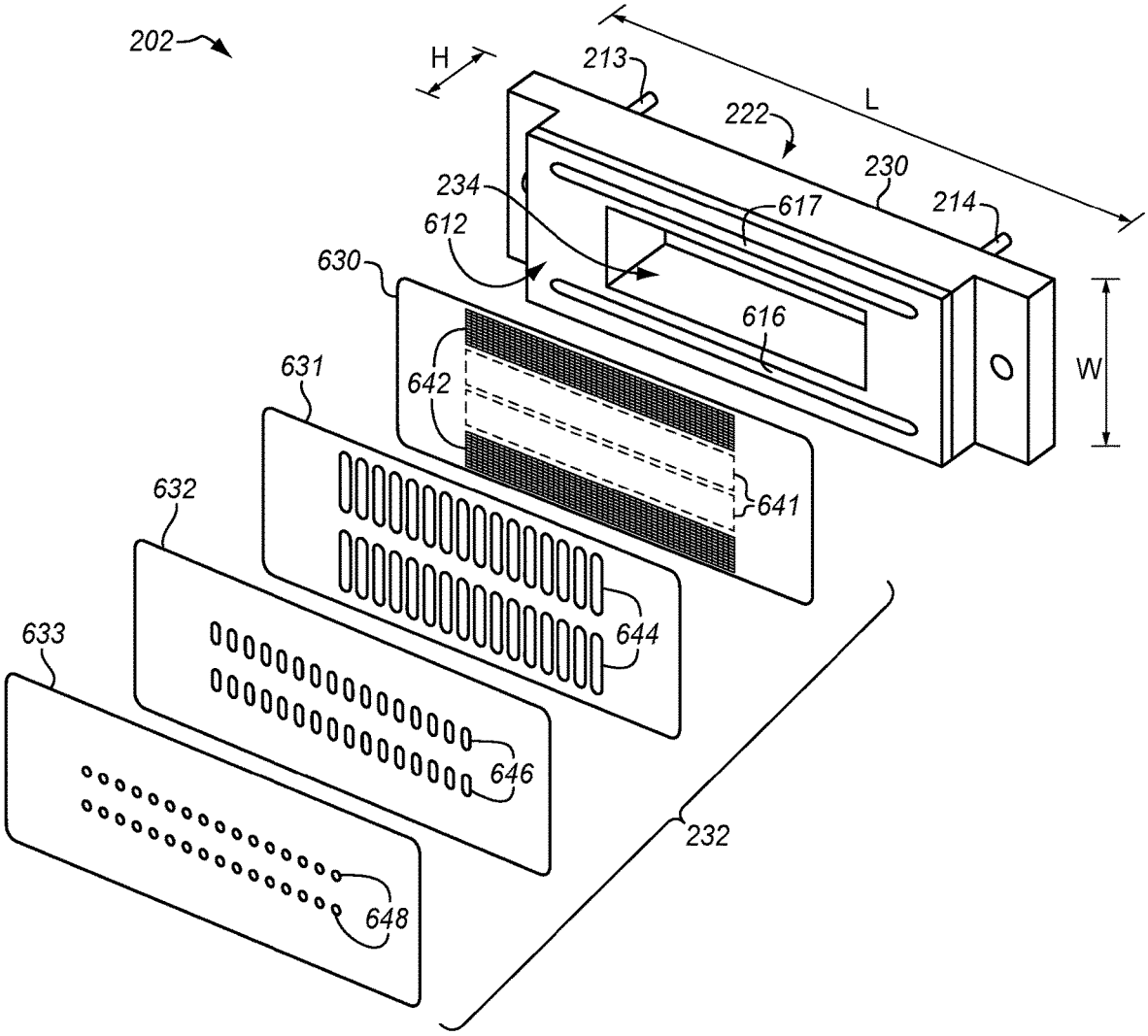
FIG. 6 illustrates an exploded, perspective view of a head member of a printhead in an illustrative embodiment.
Figure 7:
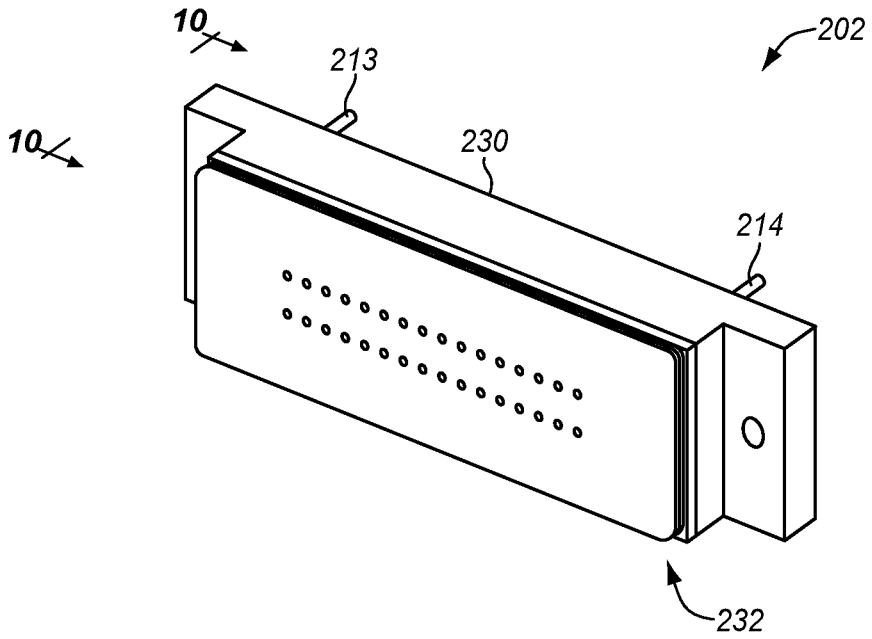
FIG. 7 is a perspective view of a head member in an illustrative embodiment.

FIG. 6 illustrates an exploded, perspective view of a head member 202 of a printhead 104 in an illustrative embodiment. The illustration in FIG. 6 is of a basic structure to show components of a head member 202, and the actual structure of printhead 104 may vary as desired. In this embodiment, head member 202 is an assembly that includes housing 230 and plate stack 232. Plate stack 232 is affixed or attached to housing 230, and forms one or more rows of jetting channels 302. FIG. 7 is a perspective view of head member 202 in an illustrative embodiment. In FIG. 7, plate stack 232 is attached or affixed to housing 230.

In FIG. 6, housing 230 is an elongated member made from a rigid material, such as stainless steel. Housing 230 has a length (L), a width (W), and a height (H), and the dimensions of housing 230 are such that the length is greater than the width. The direction of a row of jetting channels 302 corresponds with the length of housing 230. Housing 230 includes access hole 234 at or near its center that extends from I/O surface 222 through to an opposing interface surface 612. Access hole 234 provides passage way for an actuator assembly (not shown), such as a plurality of piezoelectric actuators, to pass through and contact diaphragms of the jetting channels. Interface surface 612 is the surface of housing 230 that faces plate stack 232, and interfaces with a plate of plate stack 232. Housing 230 also includes one or more manifold ducts 616-617 that extend substantially along a length of interface surface 612. A manifold duct 616-617 comprises an elongated cut or groove along interface surface 612 that is configured to convey a print fluid, and forms at least a portion of a manifold 418 for printhead 104.

Plate stack 232 includes a series of plates 630-633 that are fixed or bonded to one another to form a laminated plate structure. Plate stack 232 illustrated in FIG. 6 is intended to be an example of a basic structure of a printhead. There may be additional plates that are used in the plate stack 232 that are not shown in FIG. 6, and the configuration of the various plates may vary as desired. Also, FIG. 6 is not drawn to scale.

In this embodiment, plate stack 232 includes the following plates: a diaphragm plate 630, a restrictor plate 631, a chamber plate 632, and a nozzle plate 633. Diaphragm plate 630 is a thin sheet of material (e.g., metal, plastic, etc.) that is generally rectangular in shape and is substantially flat or planar. Diaphragm plate 630 includes diaphragm sections 641 comprising a sheet of a semi-flexible material that forms diaphragms 310 for the jetting channels 302. Diaphragm sections 641 are disposed longitudinally to correspond with the pressure chambers. Diaphragm plate 641 may also include filter sections 642 that are disposed longitudinally on opposing sides of diaphragm sections 641 to coincide with a manifold duct 616-617. Filter sections 642 are configured to remove foreign matter from print fluid flowing in the jetting channels 302 from a manifold. Although diaphragm plate 630 is shown as including both diaphragm sections 641 and filter sections 642 in this embodiment, diaphragm sections 641 and filter sections 642 may be implemented in separate plates in other embodiments.

Restrictor plate 631 is a thin sheet of material that is generally rectangular in shape and is substantially flat or planar. Restrictor plate 631 includes restrictor openings 644, which are elongated apertures or holes through restrictor plate 631 transversely disposed or oriented. Restrictor openings 644 are configured to fluidly couple pressure chambers 312 of the jetting channels 302 with a manifold.

Chamber plate 632 is a thin sheet of material that is generally rectangular in shape and is substantially flat or planar. Chamber plate 632 includes chamber openings 646 disposed toward a middle region of chamber plate 632. Chamber openings 646 comprise apertures or holes through chamber plate 632 that form pressure chambers 312 for the jetting channels 302.

Nozzle plate 633 is a thin sheet of material that is generally rectangular in shape and is substantially flat or planar. Nozzle plate 633 includes circular apertures or holes 648 that form nozzles 314 of the jetting channels 302. In this embodiment, nozzles 314 are arranged in two nozzle rows. However, nozzles 314 may be arranged in a single row or in more than two rows in other embodiments.

Figure 8:
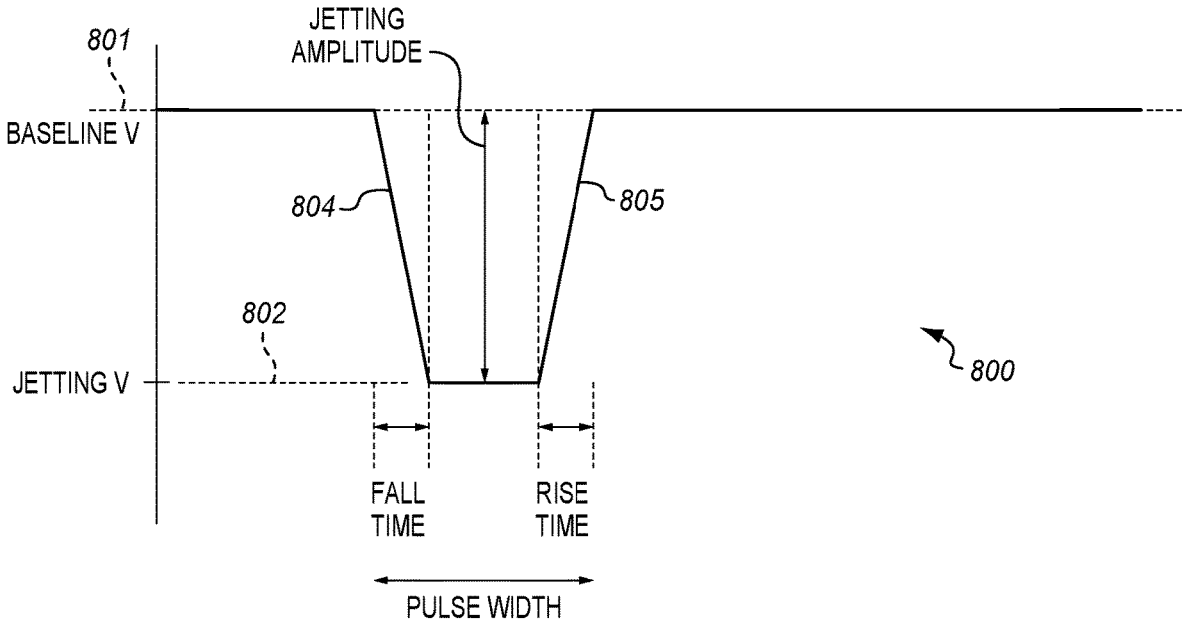
FIG. 8 illustrates a jetting pulse of a drive waveform for a printhead in an illustrative embodiment.

A controller (e.g., jetting apparatus controller 122) in communication with printhead 104 includes a drive waveform generator (also referred to as a pulse generator) that is configured to generate a drive waveform (e.g., a trapezoidal waveform) for a driver circuit in printhead 104. A drive waveform is a series or train of jetting pulses that are selectively applied to actuators 316 of the jetting channels 302. FIG. 8 illustrates a jetting pulse 800 of a drive waveform for a printhead in an illustrative embodiment. The drive waveform in FIG. 8 is shown as an active-low signal, but may be an active-high signal in other embodiments. Jetting pulse 800 has a trapezoidal shape, and may be characterized by the following parameters: fall time, rise time, pulse width, and jetting amplitude. Jetting pulse 800 transitions from a baseline (high) voltage 801 to a jetting (low) voltage 802 along a leading edge 804. The potential difference between the baseline voltage 801 and the jetting voltage 802 represents the amplitude of jetting pulse 800, which is a peak amplitude of jetting pulse 800. Jetting pulse 800 then transitions from jetting (low) voltage 802 to baseline (high) voltage 801 along a trailing edge 805. These parameters of jetting pulse 800 can impact the jetting characteristics of the droplets from a jetting channel 302 (e.g., droplet velocity and mass). For example, when the amplitude of jetting pulse 800 equals a target jetting amplitude (i.e., the jetting voltage) for a target pulse width, a droplet of a desired velocity and mass is jetted from a jetting channel 302. A standard jetting pulse 800 may be selected for different types of printheads to produce droplets having a desired shape (e.g., spherical), size, velocity, etc.

The following provides an example of jetting a droplet from a jetting channel 302 using jetting pulse 800, such as from a jetting channel 302 in FIGS. 3-4. Jetting pulse 800 is initially at the baseline voltage 801, and transitions from the baseline voltage 801 to the jetting voltage 802. The leading edge 804 (i.e., the first slope) of jetting pulse 800 causes an actuator 316 to displace in a first direction, which enlarges pressure chamber 312 and generates negative pressure waves within pressure chamber 312. The negative pressure waves propagate within pressure chamber 312 and are reflected by structural changes in pressure chamber 312 as positive pressure waves. The trailing edge 805 (i.e., the second slope) of jetting pulse 800 causes the actuator 316 to displace in an opposite direction, which reduces pressure chamber 312 to its original size and generates another positive pressure wave. When the timing of the trailing edge 805 of jetting pulse 800 is appropriate, the positive pressure waves created by actuator 316 displacing to reduce the size of pressure chamber 312 will combine with the reflected positive pressure waves to form a combined wave that is large enough to cause a droplet to be jetted from nozzle 314 of jetting channel 302. Therefore, the positive pressure waves generated by the trailing edge 805 of jetting pulse 800 acts to amplify the positive pressure waves that reflect within pressure chamber 312 due to the leading edge 804 of jetting pulse 800. The geometry of pressure chamber 312 and jetting pulse 800 are designed to generate a large positive pressure peak at nozzle 314, which drives the print fluid through nozzle 314.

Figure 9:
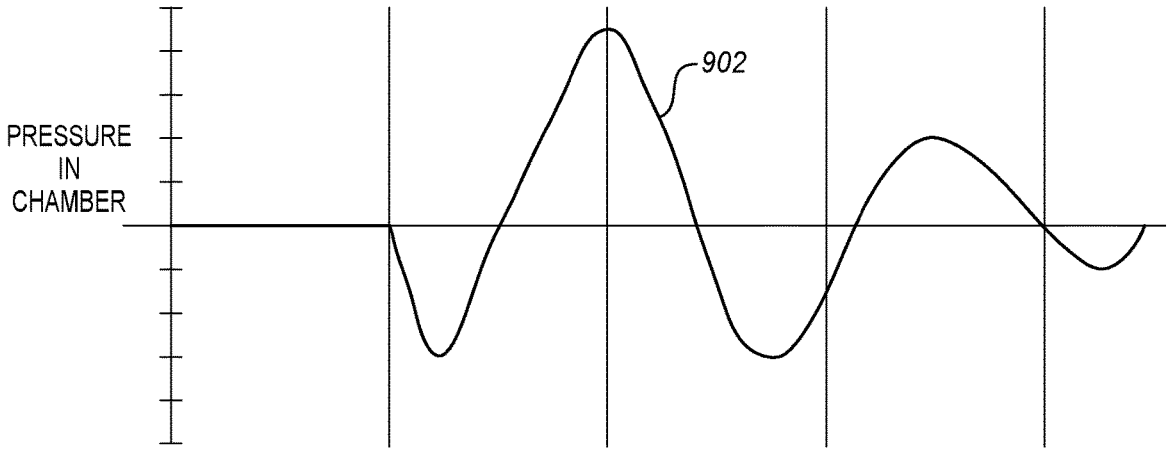
FIG. 9 illustrates a pressure wave in a pressure chamber of a jetting channel in an illustrative embodiment.

FIG. 9 illustrates a pressure wave 902 in a pressure chamber 312 of a jetting channel 302 in an illustrative embodiment. When an actuator 316 displaces in response to a jetting pulse 800, the pressure waves 902 will resonate or absorb at a characteristic frequency. This characteristic frequency is determined by the geometry of the pressure chamber 312 (and other structures of a jetting channel 302) and their associated fluidic properties, and is referred to as the resonant frequency or Helmholtz frequency of a jetting channel 302.

Because multiple jetting channels 302 are or will be connected to a common manifold 418 in a printhead 104, the pressure waves 902 may escape from the jetting channels 302 and propagate along manifold 418 in the nozzle row direction. If a manifold 418 were to vibrate at the same frequency as the jetting channels 302, the manifold vibration can excite the pressure waves in the manifold 418 that escaped from the jetting channels 302. This can unfortunately lead to a variation in jetting performance from channel-to-channel.

Figure 10:
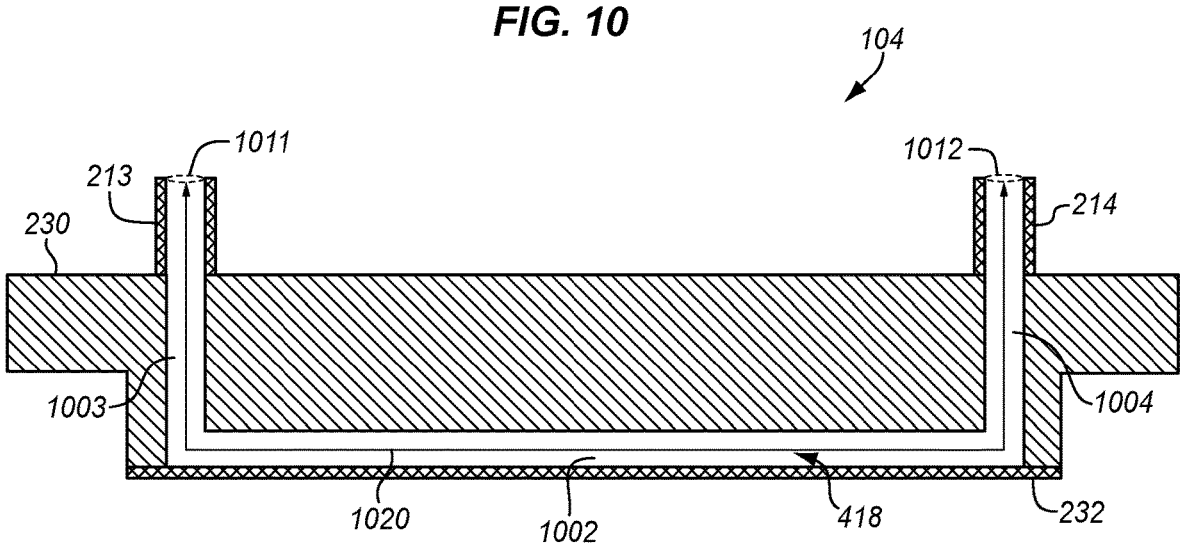
FIG. 10 is a cross-sectional view of a printhead in an illustrative embodiment.

To address this issue, the length of a manifold 418 in printhead 104 is selected so that its resonant frequencies are different than the resonant frequency of the jetting channels 302. FIG. 10 is a cross-sectional view of a printhead 104 in an illustrative embodiment. The cross-section shown in FIG. 10 is along view arrows 10-10 in FIG. 7. This cross-sectional view shows a manifold 418 of printhead 104. In this embodiment, manifold 418 includes a longitudinal section 1002 that is generally disposed longitudinally within printhead 104 along a row of jetting channels 302. Longitudinal section 1002 is formed at least in part from a manifold duct 617 of housing 230 (see FIG. 6). Manifold 418 also includes transverse sections 1003-1004 that are generally disposed transversely within printhead 104 between longitudinal section 1002 and open ends 1011-1012, respectively. The length 1020 of manifold 418 is therefore defined as the length of a fluid path between open end 1011 and open end 1012. Along length 1020, manifold 418 is formed with one or more structural elements of printhead 104 having the same or similar materials. For example, a metal, metal alloy, etc., may form manifold 418 along length 1020 between open ends 1011-1012 so that the material properties are consistent along length 1020. Also, the volume of manifold 418 may be consistent along length 1020. In this embodiment, the length 1020 of manifold 418 is selected so that the resonant frequencies of manifold 418 are different than the resonant frequency of the jetting channels 302.

Figure 11:
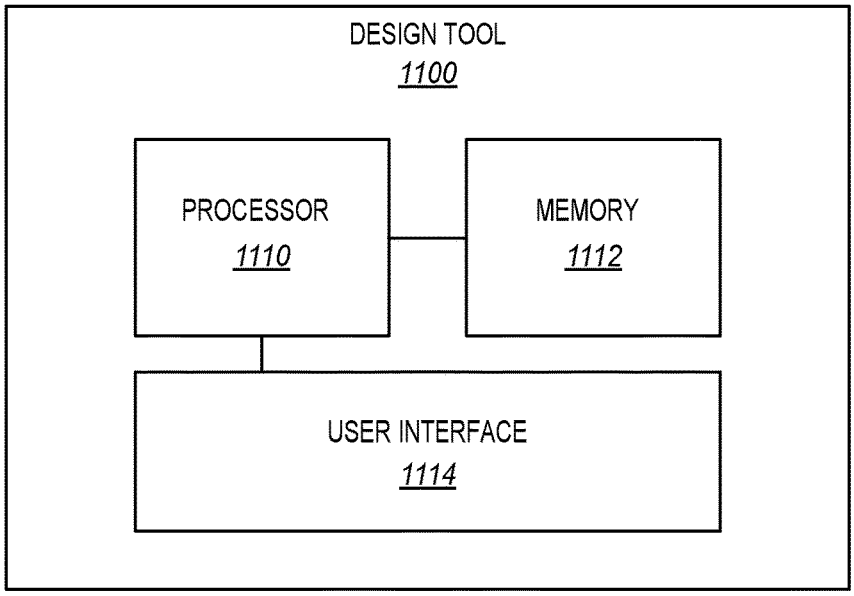
FIG. 11 is a schematic diagram of a design tool for a printhead in an illustrative embodiment.

FIG. 11 is a schematic diagram of a design tool 1100 for a printhead 104 in an illustrative embodiment. Design tool 1100 is an apparatus or device configured to assist in the design of a printhead, such as printhead 104. More particularly, design tool 1100 may be configured to determine one or more dimensions of a manifold 418 in a printhead 104, although design tool 1100 may be configured to determine other design aspects of a printhead 104. Design tool 1100 includes a hardware platform that includes a processor 1110 and memory 1112. Processor 1110 comprises an integrated hardware circuit configured to execute instructions stored in memory 1112. Memory 1112 is a non-transitory computer readable storage medium for data, instructions, etc., and is accessible by processor 1110. Design tool 1100 may further include a user interface 1114. User interface 1114 is a hardware component for interacting with an end user. For example, user interface 1114 may include a display, screen, touch screen, or the like (e.g., a Liquid Crystal Display (LCD), a Light Emitting Diode (LED) display, etc.). User interface 1114 may include a keyboard or keypad, a tracking device (e.g., a trackball or trackpad), a speaker, a microphone, etc. Design tool 1100 may include various other components not specifically illustrated in FIG. 11.

Figure 12:
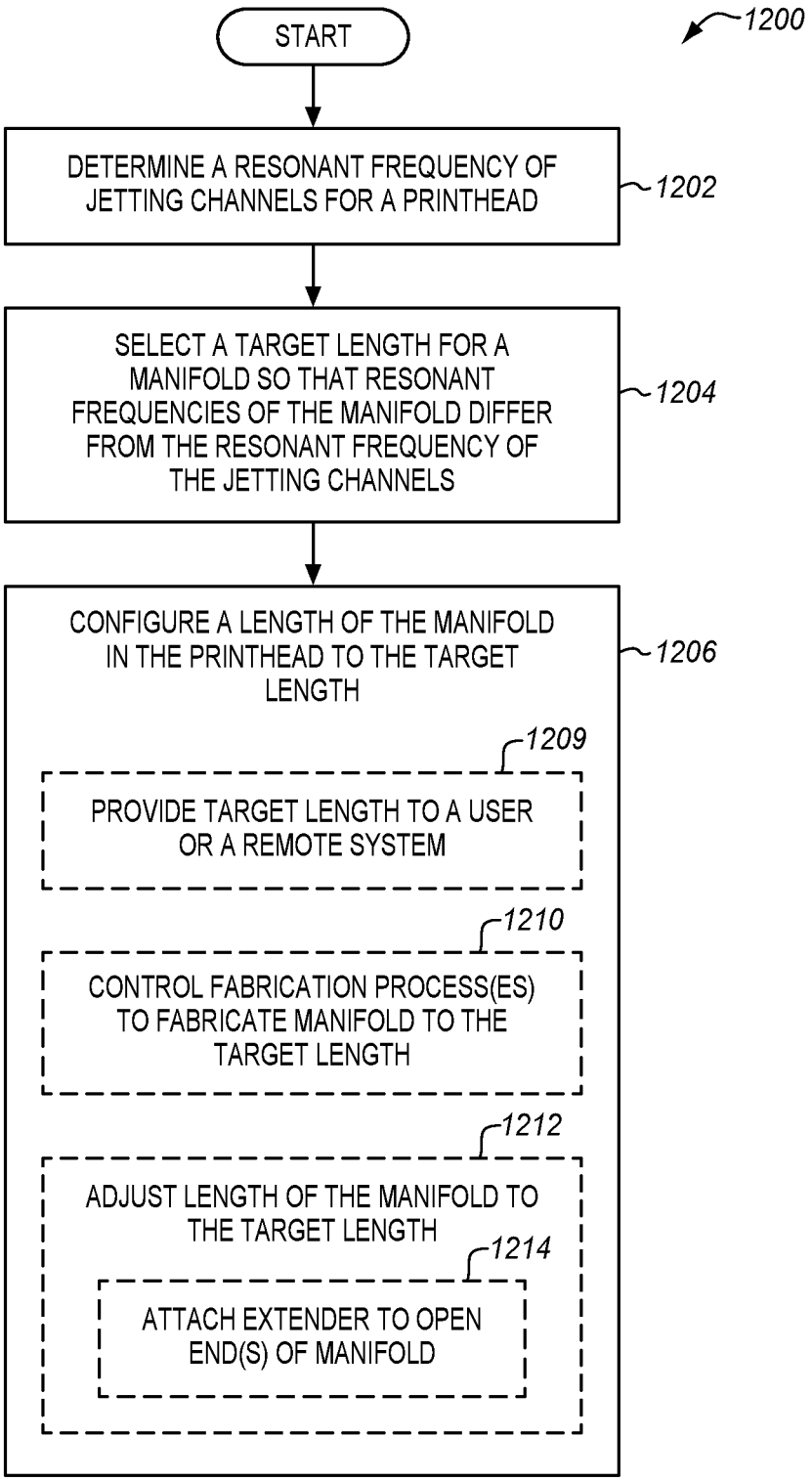
FIG. 12 is a flow chart illustrating a method of designing a printhead in an illustrative embodiment.

FIG. 12 is a flow chart illustrating a method 1200 of designing a printhead 104 in an illustrative embodiment. The steps of method 1200 will be described with reference to design tool 1100 in FIG. 11, but those skilled in the art will appreciate that method 1200 may be performed by other systems, tools, or entities. Also, the steps of the flow charts described herein are not all inclusive and may include other steps not shown, and the steps may be performed in an alternative order.

It is assumed for this embodiment that a printhead 104 includes or will include a manifold 418, and that the manifold 418 is fluidly coupled to a plurality of jetting channels 302 such as described above. Method 1200 includes determining a resonant frequency of the jetting channels 302 for the printhead 104 (step 1202). For example, design tool 1100 may perform a test on printhead 104 or a similar printhead (i.e., another printhead with jetting channels having the same or similar dimensions), or may receive test data regarding the printhead 104 or a similar printhead to determine the resonant frequency of the jetting channels 302. Design tool 1100 may perform a simulation on printhead 104 or a similar printhead, or may receive simulation data regarding the printhead 104 or a similar printhead to determine the resonant frequency of the jetting channels 302. Design tool 1100 may determine the resonant frequency of jetting channels 302 in other ways.

The manifold 418 has or will have a natural frequency of vibration determined by the physical parameters of the manifold 418. One of the parameters that defines the natural frequency of vibration of manifold 418 is the length 1020 of the manifold 418. Method 1200 includes selecting, determining, or calculating a target length for manifold 418 such that resonant frequencies of manifold 418 differ from the resonant frequency of the jetting channels 302 by a threshold amount (step 1204). In other words, the target length is selected so that the resonant frequencies of manifold 418 do not coincide with the resonant frequency (and any harmonics) of the jetting channels 302. As described above, if a resonant frequency of the manifold 418 is the same as the resonant frequency of the jetting channels 302, vibration of the manifold 418 can excite pressures waves that escape from the jetting channels 302. Thus, it is desirable to identify a length of manifold 418 that naturally vibrates at resonant frequencies that are different than the resonant frequency of the jetting channels 302. Design tool 1100 may display or otherwise provide the target length to a user through user interface 1114, transmit the target length over a network to a remote system, or perform other functions when selecting the target length.

In one embodiment, design tool 1100 may determine a plurality of prospective lengths for manifold 418, where each of the prospective lengths results in resonant frequencies that are different than the resonant frequency of the jetting channels 302. Design tool 1100 may then select the target length of manifold 418 from one of the prospective lengths. For example, design tool 1100 may select (e.g., automatically) the target length based on other dimensions of the printhead 104. In another example, design tool 1100 may display or otherwise provide the prospective lengths to a user through user interface 1114, and receive a selection of the target length from the user.

Method 1200 may further include configuring a length 1020 of the manifold 418 in the printhead 104 to the target length (step 1206). In FIG. 10, for example, the length 1020 of manifold 418 from open end 1011 to open end 1012 will be set at the target length. In one embodiment, design tool 1100 may display or otherwise provide the target length (optional step 1209) to a user through user interface 1114, over a network to a remote system, or perform other functions when selecting the target length. In another embodiment, printhead 104 may be in the design stage, pre-fabrication stage, or fabrication stage for method 1200. Design tool 1100 or another system/entity may control, regulate, set, or instruct one or more fabrication processes to fabricate the manifold 418 to the target length (optional step 1210). For example, manifold ducts 616-617 in housing 230 may be cut or formed based on the target length (see FIG. 6), the height of housing 230 may be selected based on the target length, the length of hose couplers for I/O ports 213-214 may be selected based on the target length, etc.

Figure 13:
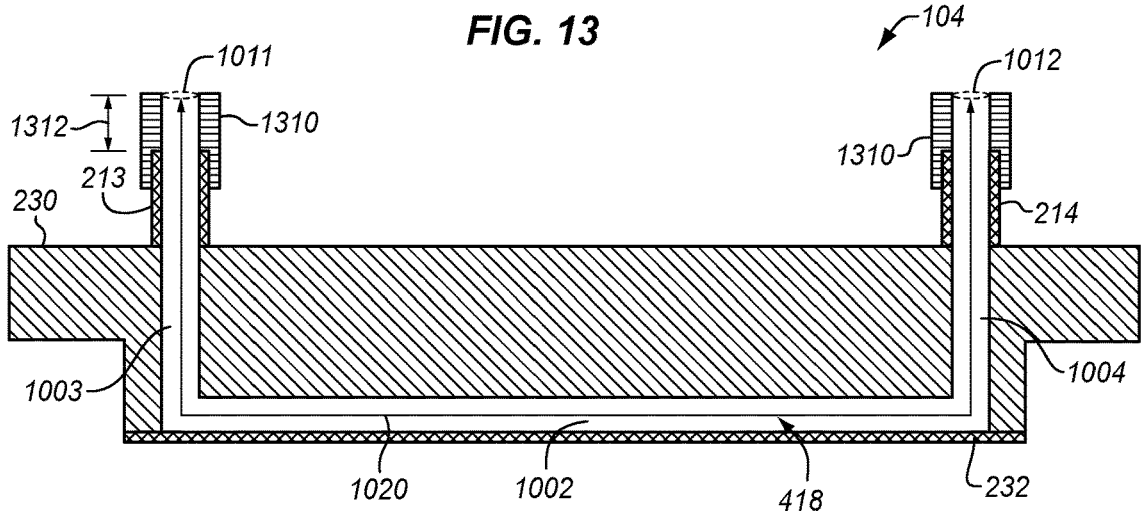
FIG. 13 is a cross-sectional view of a printhead with extenders in an illustrative embodiment.

In another embodiment, printhead 104 may comprise an already-fabricated head, referred to generally as an assembled printhead. In an assembled printhead, the length 1020 of a manifold 418 may be adjusted to the target length (optional step 1212). In one embodiment, one or more extenders or a similar type of structural element may be used to adjust a length 1020 of a manifold 418 to the target length. FIG. 13 is a cross-sectional view of printhead 104 with extenders 1310 in an illustrative embodiment. In this embodiment, an extender 1310 may be attached, affixed, or appended to at least one of the open ends 1011-1012 of manifold 418 to extend the manifold 418 to the target length (optional step 1214 of FIG. 12). An extender 1310 may be attached to an I/O port 213-214 of printhead 104 where a print fluid enters or exits printhead 104. An extender 1310 is a hollow structural member with a fluid path that aligns with manifold 418. Extenders 1310 may be made from the same or a similar type of material as housing 230 and/or I/O port 213-214, such as to have a similar or equivalent rigidity. Extenders 1310 have an extension length 1312 that functions to move the open ends 1011-1012 of manifold 418, and change the length 1020 of manifold 418. Thus, the extension length 1312 of an extender 1310 may be determined or selected, such as from set of standard extender sizes, so that the manifold length of an existing printhead 104 can be changed to a target length. An extender 1310 may be applied to one or both open ends 1011-1012. If extenders 1310 are applied to both open ends 1011-1012, the extenders 1310 may have different extension lengths 1312. If an I/O port 213-214 attaches to a reservoir 124 via a hose or the like, then an extender 1310 may be attached to a hose coupling of the I/O port 213-214. Also, the outer surface of an extender 1310 may include a hose coupling or hose barb so that a hose may directly attach to the extender 1310.

Method 1200 may be repeated for any number of manifolds 418 to determine a target length for each of the manifolds 418.

A manifold 418 as shown in FIG. 10 is an enclosed fluid passageway with open ends 1011-1012. Thus, design tool 1100 may determine the target length for manifold 418 by modeling the manifold 418 as an open-end air column in one embodiment. The resonant frequencies of an open-end air column depend on the speed of sound in air, and the length and geometry of the air column. Longitudinal pressure waves reflect from the open ends to set up standing wave patterns. The lowest resonant frequency of the air column is referred to as the fundamental frequency (or first harmonic). The air column also produces harmonics of the fundamental frequency, which are integer (whole number) multiples of the fundamental frequency.

The fundamental frequency ($f_1$) of an open-end air column may be determined based on Equation [1]:

$$f_1 = \frac{V_{sound}}{2L}$$

where $V_{sound}$ is the speed of sound in air, and L is the length of the air column. The harmonics of the air column are integer (whole number) multiples of the fundamental frequency. For example, the first harmonic (N=2) is $2*f_1$, the second harmonic (N=3) is $3*f_1$, etc. Using Equation [1], design tool 1100 may determine the resonant frequencies for different lengths of a manifold 418, and select a target length that produces resonant frequencies that differ from the resonant frequency of the jetting channels 302.

The above equation may be used to directly solve for a target length of a manifold 418 modeled based on an open-end air column. For example, Equation [1] may be rearranged to solve for L as in Equation [2]:

$$L = \frac{V_{sound}}{2f}$$

If the resonant frequency of the jetting channels 302 was used for the frequency (f) in Equation [2] and the speed of sound in a print fluid was used for $V_{sound}$, then Equation [2] would produce a length (L) of a manifold 418 having a fundamental frequency that matches the resonant frequency of the jetting channels 302. However, the goal is to select a target length of a manifold 418 having resonant frequencies that differ from the resonant frequency of the jetting channels 302. Thus, an adjustment percentage may be added to Equation [2] to avoid or exclude lengths having resonant frequencies that match the resonant frequency of the jetting channels 302. The adjustment percentage may depend on the threshold amount of difference desired between resonant frequencies of the manifold 418 and the resonant frequency of the jetting channels 302. For example, the adjustment percentage may be selected from a range of 0.2-0.8 (e.g., 0.2, 0.3, 0.4, 0.5, 0.6, 0.7, 0.8), or another desired percentage. Thus, a target length of a manifold 418 may be calculated based on Equation [3]:

$$L = \frac{(N + \%_{adj}) * V_{sound}}{2f}$$

where N is the integer of a harmonic, $V_{sound}$ is the speed of sound in a print fluid (e.g., 1200-1500 mps), $\%_{adj}$ is the adjustment percentage, and f is the resonant frequency (i.e., fundamental frequency) of the jetting channels 302. When the adjustment percentage is set to "0.5", Equation [3] may produce an "optimal" target length for a manifold 418. The optimal target length produces resonant frequencies for a manifold such that the resonant frequency of the jetting channels 302 is halfway between the resonant frequencies of the manifold. Thus, the node(s) of a resonant frequency of the manifold 418 is as far as possible from the node(s) of the resonant frequency of the jetting channels 302.

Figure 14:
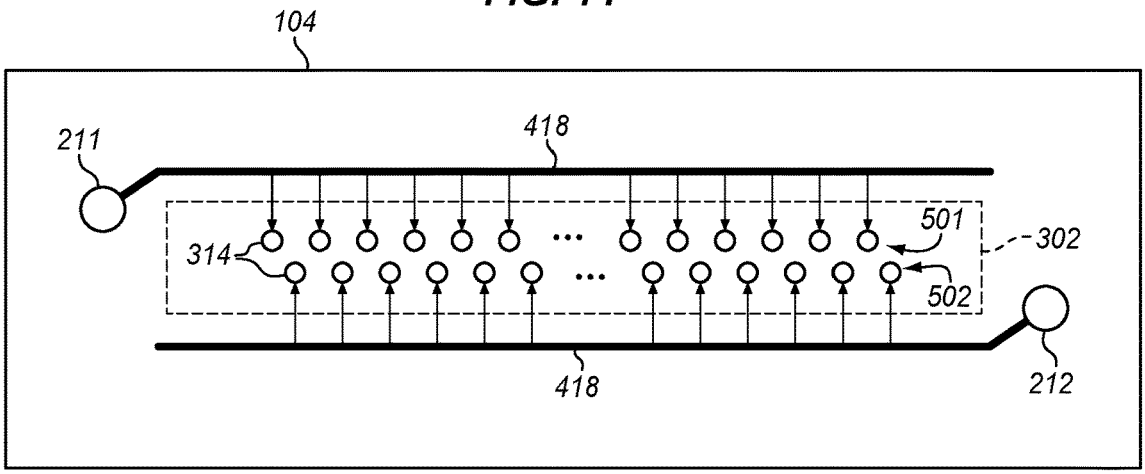
FIG. 14 is a schematic diagram of a printhead in an illustrative embodiment.

In the above embodiment, a manifold 418 comprised a fluid path with two open ends 1011-1012. In another embodiment, a manifold 418 may include one open end and one closed end. FIG. 14 is a schematic diagram of a printhead 104 in an illustrative embodiment. The jetting channels 302 of printhead 104 are again schematically illustrated as nozzles 314 in two nozzle rows 501-502. Printhead 104 (i.e., head member 202) includes a plurality of manifolds 418. One of the manifolds 418 includes a single I/O port 211, and is fluidly coupled to the jetting channels 302 in nozzle row 501. Another one of the manifolds 418 includes a single I/O port 212, and is fluidly coupled to the jetting channels 302 in nozzle row 502.

Figure 15:
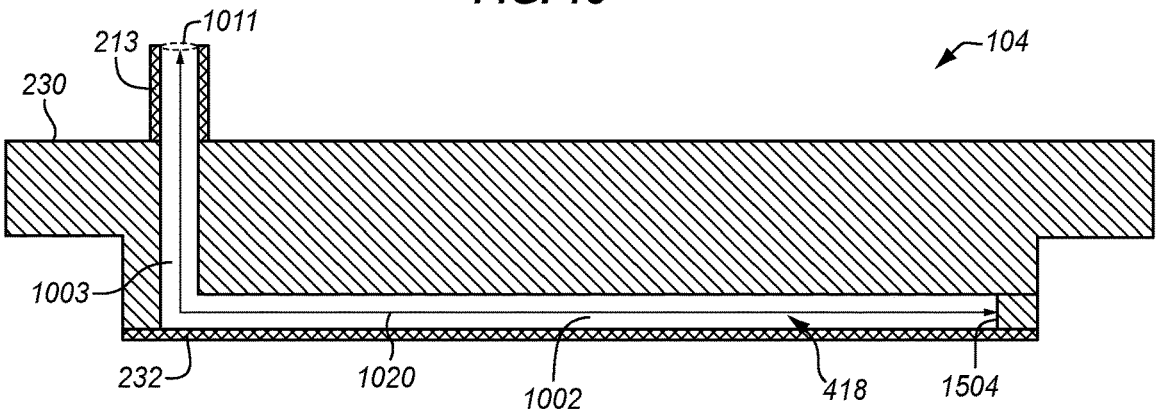
FIG. 15 is a cross-sectional view of a printhead in an illustrative embodiment.

FIG. 15 is a cross-sectional view of printhead 104 in an illustrative embodiment, showing a manifold 418. In this embodiment, manifold 418 includes a longitudinal section 1002 that is generally disposed longitudinally within printhead 104 along a row of jetting channels 302. Manifold 418 also includes a transverse section 1003 that is generally disposed transversely within printhead 104 between longitudinal section 1002 and open end 1011. The length 1020 of manifold 418 is therefore defined as the length of a fluid path between open end 1011 and a closed end 1504. As in the above embodiment, the length 1020 of manifold 418 is selected so that the resonant frequencies of manifold 418 are different than the resonant frequency of the jetting channels 302.

Design tool 1100 may determine the target length by modeling manifold 418 in FIG. 15 as a closed-end air column in one embodiment. The resonant frequencies of a closed-end air column depend on the speed of sound in air, and the length and geometry of the air column. The closed-end air column will produce resonant standing waves at a fundamental frequency and at odd harmonics.

The fundamental frequency ($f_1$) of a closed-end air column may be determined based Equation [4]:

$$f_1 = \frac{V_{sound}}{4L}$$

where $V_{sound}$ is the speed of sound, and L is the length of the air column. The harmonics of the air column are odd integer multiples of the fundamental frequency.

A target length of a manifold 418 as shown in FIG. 15 may be calculated based on Equation [5]:

$$L = \frac{(N + \%_{adj}) * V_{sound}}{4f}$$

where N is an odd integer of a harmonic, $V_{sound}$ is the speed of sound in a print fluid, $\%_{adj}$ is the adjustment percentage, and f is the resonant frequency of the jetting channels 302.

The above systems and methods may be used to select a target length for any type of manifold in a printhead. The manifolds 418 illustrated in FIGS. 5 and 14 may be considered supply manifolds that convey a print fluid to the jetting channels 302. However, a flow-through type of printhead is also considered herein that includes one or more supply manifolds, and one or more return manifolds. A flow-through type of printhead is described in U.S. Pat. No. 9,272,514, which is incorporated by reference as if fully included herein. The above systems and methods may be used to select a target length for a return manifold in a printhead, as well as a supply manifold.

Figure 16:
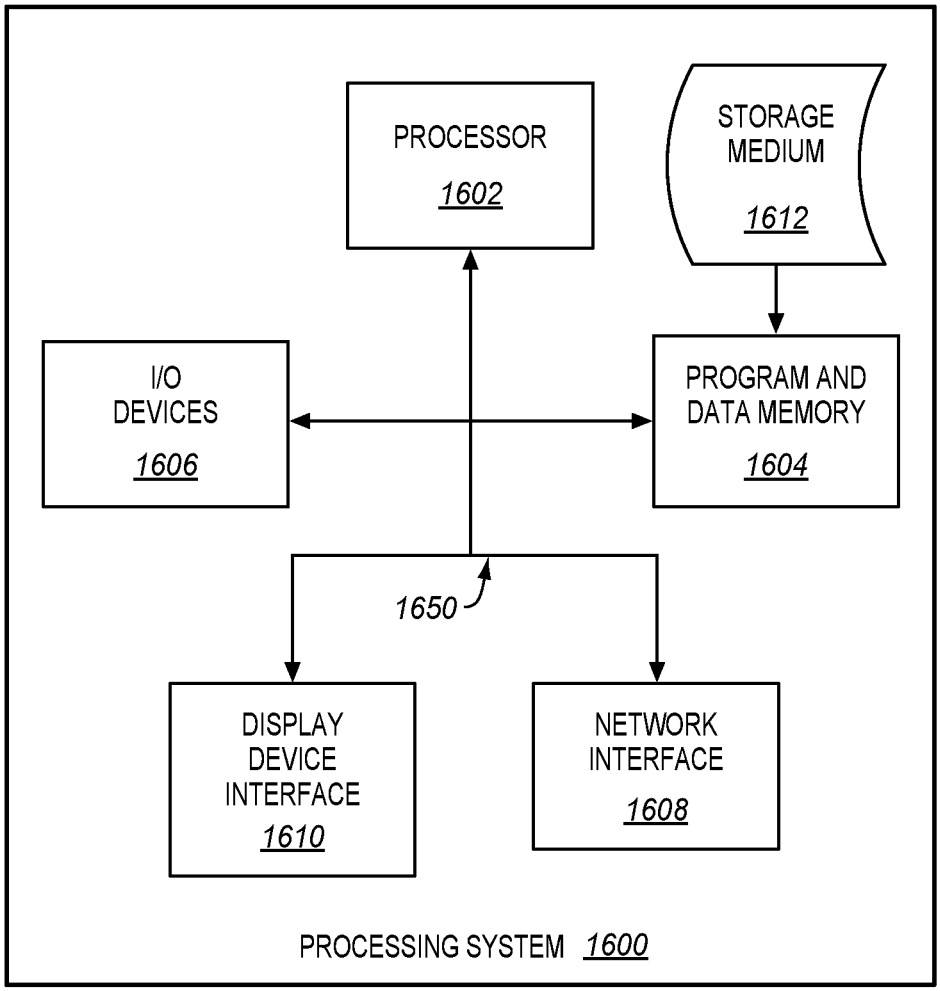
FIG. 16 illustrates a processing system operable to execute a computer readable medium embodying programmed instructions to perform desired functions in an illustrative embodiment.

Embodiments disclosed herein can take the form of software, hardware, firmware, or various combinations thereof. In one particular embodiment, software is used to direct a processing system of design tool 1100 to perform the various operations disclosed herein. FIG. 16 illustrates a processing system 1600 operable to execute a computer readable medium embodying programmed instructions to perform desired functions in an illustrative embodiment. Processing system 1600 is operable to perform the above operations by executing programmed instructions tangibly embodied on computer readable storage medium 1612. In this regard, embodiments can take the form of a computer program accessible via computer-readable medium 1612 providing program code for use by a computer or any other instruction execution system. For the purposes of this description, computer readable storage medium 1612 can be anything that can contain or store the program for use by the computer.

Computer readable storage medium 1612 can be an electronic, magnetic, optical, electromagnetic, infrared, or semiconductor device. Examples of computer readable storage medium 1612 include a solid-state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 1600, being suitable for storing and/or executing the program code, includes at least one processor 1602 coupled to program and data memory 804 through a system bus 1650. Program and data memory 1604 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 1606 (including but not limited to keyboards, displays, pointing devices, etc.) can be coupled either directly or through intervening I/O controllers. Network adapter interfaces 1608 may also be integrated with the system to enable processing system 1600 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 1610 may be integrated with the system to interface to one or more display devices, such as printing systems and screens for presentation of data generated by processor 1602.

Although specific embodiments were described herein, the scope of the invention is not limited to those specific embodiments. The scope of the invention is defined by the following claims and any equivalents thereof

What is claimed is:

1. A method comprising:

determining a resonant frequency of jetting channels for a printhead; and selecting a target length for a manifold fluidly coupled to the jetting channels such that resonant frequencies of the manifold differ from the resonant frequency of the jetting channels by a threshold amount.

2. The method of claim 1 wherein:

the manifold comprises a fluid path between a first open end and a second open end; and selecting the target length for the manifold comprises modeling the manifold as an open-end air column.

3. The method of claim 2 wherein:

selecting the target length for the manifold comprises calculating the target length based on:

$$L = \frac{(N + \%_{adj}) * V_{sound}}{2f}$$

where N is a harmonic number, $\%_{adj}$ is an adjustment percentage, $V_{sound}$ is the speed of sound in a print fluid, and f is the resonant frequency of the jetting channels.

4. The method of claim 1 wherein:

the manifold comprises a fluid path between an open end and a closed end; and selecting the target length for the manifold comprises modeling the manifold as a closed-end air column.

5. The method of claim 4 wherein:

selecting the target length for the manifold comprises calculating the target length based on:

$$L = \frac{(N + \%_{adj}) * V_{sound}}{4f}$$

where N is an odd harmonic number, $\%_{adj}$ is an adjustment percentage, $V_{sound}$ is the speed of sound in a print fluid, and f is the resonant frequency of the jetting channels.

6. The method of claim 1 further comprising:

provide the target length of the manifold to a user via a user interface.

7. The method of claim 1 further comprising:

controlling at least one fabrication process to fabricate the manifold to the target length.

8. The method of claim 1 wherein:

the printhead comprises an assembled printhead; and the method further comprises adjusting a length of the manifold of the assembled printhead to the target length.

9. The method of claim 8 wherein:

adjusting the length of the manifold of the assembled printhead comprises attaching an extender to at least one open end of the manifold to extend the manifold to the target length.

10. A design tool for a printhead, comprising:

at least one processor and memory;

the at least one processor causes the design tool to:

determine a resonant frequency of jetting channels for the printhead; and select a target length for a manifold fluidly coupled to the jetting channels such that resonant frequencies of the manifold differ from the resonant frequency of the jetting channels by a threshold amount.

11. The design tool of claim 10 wherein:

the manifold comprises a fluid path between a first open end and a second open end; and the at least one processor causes the design tool to select the target length for the manifold by modeling the manifold as an open-end air column.

12. The design tool of claim 11 wherein:

the at least one processor causes the design tool to calculate the target length based on:

$$L = \frac{(N + \%_{adj}) * V_{sound}}{2f}$$

where N is a harmonic number, $\%_{adj}$ is an adjustment percentage, $V_{sound}$ is the speed of sound in a print fluid, and f is the resonant frequency of the jetting channels.

13. The design tool of claim 10 wherein:

the manifold comprises a fluid path between an open end and a closed end; and the at least one processor causes the design tool to select the target length for the manifold by modeling the manifold as a closed-end air column.

14. The design tool of claim 13 wherein:

the at least one processor causes the design tool to calculate the target length based on:

$$L = \frac{(N + \%_{adj}) * V_{sound}}{4f}$$

where N is an odd harmonic number, $\%_{adj}$ is an adjustment percentage, $V_{sound}$ is the speed of sound in a print fluid, and f is the resonant frequency of the jetting channels.

15. The design tool of claim 10 wherein:

the at least one processor causes the design tool to control at least one fabrication process to fabricate the manifold to the target length.

16. The design tool of claim 10 further comprising:

a user interface configured to provide the target length of the manifold to a user.

17. A printhead comprising:

a plurality of jetting channels; and a manifold fluidly coupled to the jetting channels;

wherein a length of the manifold is selected to produce resonant frequencies that differ from a resonant frequency of the jetting channels by a threshold amount.

18. The printhead of claim 17 wherein:

the manifold comprises a fluid path between a first open end and a second open end; and the length of the manifold is selected based on:

$$L = \frac{(N + \%_{adj}) * V_{sound}}{2f}$$

where N is a harmonic number, $\%_{adj}$ is an adjustment percentage in a range of 0.2-0.8, $V_{sound}$ is the speed of sound in a print fluid, and f is the resonant frequency of the jetting channels.

19. The printhead of claim 17 wherein:

the manifold comprises a fluid path between an open end and a closed end; and the length of the manifold is selected based on:

$$L = \frac{(N + \%_{adj}) * V_{sound}}{4f}$$

where N is an odd harmonic number, $\%_{adj}$ is an adjustment percentage in a range of 0.2-0.8, $V_{sound}$ is the speed of sound in a print fluid, and f is the resonant frequency of the jetting channels.

20. A jetting apparatus comprising:

at least one printhead of claim 17.

* * * * *